US007438849B2

(12) United States Patent
Kuramoto et al.

(10) Patent No.: US 7,438,849 B2
(45) Date of Patent: Oct. 21, 2008

(54) TITANIUM ALLOY AND PROCESS FOR PRODUCING THE SAME

(75) Inventors: Shigeru Kuramoto, Nagoya (JP); Tadahiko Furuta, Seto (JP); Junghwan Hwang, Nagoya (JP); Rong Chen, Aichi-gun (JP); Nobuaki Suzuki, Nisshin (JP); Kazuaki Nishino, Seto (JP); Takashi Saito, Nagoya (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 288 days.

(21) Appl. No.: 10/663,786

(22) Filed: Sep. 17, 2003

(65) Prior Publication Data

US 2004/0055675 A1 Mar. 25, 2004

(30) Foreign Application Priority Data

Sep. 20, 2002 (JP) ..... 2002-275171
Aug. 4, 2003 (JP) ..... 2003-205780

(51) Int. Cl.
*C22C 14/00* (2006.01)

(52) U.S. Cl. ..... 420/417; 148/407; 148/669

(58) Field of Classification Search ..... 420/417; 148/407, 669

See application file for complete search history.

(56) References Cited

U.S. PATENT DOCUMENTS 5,871,595 A * 2/1999 Ahmed et al. ..... 148/421
6,607,693 B1 * 8/2003 Saito et al. ..... 420/417

FOREIGN PATENT DOCUMENTS

| | | |
|---|---|---|
| GB | 2190100 | * 11/1987 |
| JP | 05-279773 | * 10/1993 |
| JP | 7-25618 | 10/1995 |
| JP | 7-292429 | 11/1995 |
| JP | 8-224327 | 9/1996 |
| JP | 9-209099 | 8/1997 |
| JP | 9-322951 | 12/1997 |
| JP | 10-94804 | 4/1998 |
| JP | 10-265876 | 10/1998 |
| JP | 11-61297 | 3/1999 |
| JP | 2000-204425 | 7/2000 |

OTHER PUBLICATIONS

U.S. Appl. No. 10/663,786, filed Sep. 17, 2003, Kuramoto et al.

(Continued)

*Primary Examiner*—John P. Sheehan
*Assistant Examiner*—Jessee R. Roe
(74) *Attorney, Agent, or Firm*—Oblon, Spivak, McClelland, Maier & Neustadt, P.C.

(57) ABSTRACT

A titanium alloy includes at least one alloying element whose molybdenum equivalent "$Mo_{eq}$" is from 3 to 11% by mass, at least one interstitial solution element selected from the group consisting of O, N and C in an amount of from 0.3 to 3% by mass, and the balance of Ti, when the entirety is taken as 100% by mass. Its content of Al is controlled to 1.8% by mass or less, and it is β single phase at room temperature at least.

8 Claims, 1 Drawing Sheet

OTHER PUBLICATIONS

U.S. Appl. No. 10/019,283, filed Jan. 2, 2002, Furuta et al.
U.S. Appl. No. 10/450,530, filed Dec. 8, 2003, Hwang et al.
U.S. Appl. No. 10/471,760, filed Sep. 26, 2003, Furuta et al.
Z. Liu, et al. "Effects of Oxygen and Heat Treatment on the Mechanical Properties of Alpha and Beta Titanium Alloys", Metallurgical Transactions A, vol. 19A, Mar. 1998, pp. 527-542.
H.Y. Kim, et al. "Martensitic transformation, shape memory effect and superelasticity of Ti-Nb binary alloys" Acta Materialia, vol. 54, 2006, pp. 2419-2429.
Jae II Kim, et al. "Shape Memory Behaviour of Ti-22Nb-(0.5-2.0)O(at%) Biomeeical Alloys" Materials Transactions, vol. 46, No. 4, 2005, pp. 852-857.

* cited by examiner

TITANIUM ALLOY AND PROCESS FOR PRODUCING THE SAME

BACKGROUND OF THE INVENTION

1. Field of the Invention

The present invention relates to a titanium alloy and a process for producing the same. Particularly, it relates to a noble β titanium alloy, which can offer wider utilization fields and applications, and to a process for producing the same.

2. Description of the Related Art

Titanium alloys are often used in the special fields such as aviation, military affairs, space, deep-sea exploration and chemical plants, because they are good in terms of the specific strength and corrosion resistance. In view of the structure, titanium alloys are classified as α alloys, α+β alloys, and β alloys. α+β titanium alloys, such as Ti-6% by mass Al-4% by mass V, have been often used so far. However, β titanium alloys have been attracting engineers' attention recently, because they are good in terms of the processability, strength and flexibility. In addition to the special fields, β titanium alloys are about to be used in more familiar fields, such as organism compatible products (for instance, artificial bones), accessories (for example, clocks or watches and frames of eyeglasses) and sporting goods (for instance, golf clubs), for example.

Incidentally, which phases titanium alloys form depends greatly on the type and content of containing alloying elements. For example, β titanium alloys are usually produced by including β phase stabilizing elements such as Mo in a relatively large content and thereafter carrying out solution treatments.

In the production of β titanium alloys, there are a variety of β phase stabilizing elements to be added. However, the stabilizing degree of β phase depends on the respective elements. Moreover, even in β titanium alloys, α phase stabilizing elements such as Al are often included in an appropriate content in order to improve the strength. Accordingly, it is very meaningful if an index is available, index that judges which titanium alloys are produced in dependent of the type and content of alloying elements to be included. The molybdenum equivalent "$Mo_{eq}$" is one of such indexes. The "$Mo_{eq}$" indexes the stability of β phase. When the "$MO_{eq}$" is large sufficiently, the stability of β phase increases so that it is likely to produce β titanium alloys. On the contrary, when the "$Mo_{eq}$" is small, it is likely to produce a titanium alloys. Moreover, in the intermediate region, the resulting titanium alloys are likely to be α+β titanium alloys.

The following are literatures relating to titanium alloys: Japanese Unexamined Patent Publication (KOKAI) No. 8-224,327 (now issued as Japanese Patent No.2,999,387), Japanese Unexamined Patent Publication (KOKAI) No. 2000-204,425, Japanese Unexamined Patent Publication (KOKAI) No. 9-322,951, Japanese Unexamined Patent Publication (KOKAI) No. 7-292,429, Japanese Unexamined Patent Publication (KOKAI) No. 7-252,618, Japanese Unexamined Patent Publication (KOKAI) No. 9-209,099, Japanese Unexamined Patent Publication (KOKAI) No. 10-94,804, Japanese Unexamined Patent Publication (KOKAI) No. 10-265,876, Japanese Unexamined Patent Publication (KOKAI) No. 11-61,297, and Metallurgical Transactions A, vol. 19A, March 1998 pp. 527-542.

Among the literatures, the first four patent publications specify titanium alloys with the "$MO_{eq}$." For example, Japanese Unexamined Patent Publication (KOKAI) No. 8-224,327 discloses an α+β titanium alloy whose "$Mo_{eq}$" is from 2 to 10% by mass. Moreover, Japanese Unexamined Patent Publication (KOKAI) No. 2000-204,425 discloses an α+β titanium alloy whose "$MO_{eq}$" is from 2 to 4.5% by mass. In addition, paragraphs [0014] and [0022] of Japanese Unexamined Patent Publication (KOKAI) No. 9-322,951 disclose an α+β titanium alloy whose "$Mo_{eq}$" is from 0 to 10% by mass. In the patent publications, though as comparative examples, there are descriptions to the effect that β equi-axis crystalline single phase is formed when a Ti-10% V-2% Fe-3% Al alloy whose "$Mo_{eq}$" is 9.5% by mass and a Ti-15% V-3% Al-3% Cr-3% Sn alloy whose "$Mo_{eq}$" is 11.5% by mass are quenched from the casting states. Note that all of the contents of the constituent elements are expressed in percentages by mass.

Paragraphs [0012] of Japanese Unexamined Patent Publication (KOKAI) No. 7-292,429 discloses a quasi-stable β titanium alloy which comprises Ti, Fe, Nb and Al and whose "$Mo_{eq}$" is greater than 16% by mass. Moreover, the patent publication discloses to the effect that a 100%-β structure is formed when the five titanium alloys whose "$Mo_{eq}$" is 11.5% by mass or more are quenched from the β transformation temperature or more.

However, note that the titanium alloys disclosed in all of the four patent publications include interstitial solution elements such as oxygen (O) in a content of less than 0.3% by mass.

On the other hand, the latter five patent publications disclose titanium alloys which include O and the like in a relatively large content. All of the titanium alloys disclosed in the latter five patent publications are α+β titanium alloys, or titanium alloys comprising α' phase and β phase.

Moreover, the last literature discloses a Ti-2% by mass Al-16% by mass V-0.59% by mass O alloy. The "$Mo_{eq}$" and oxygen content of the titanium alloy is 8.7% by mass and 0.59% by mass, respectively. However, the aluminum content of the titanium alloy is so large as 2% by mass that the elastic deformability does not reach 1%. In addition, as can be seen from FIG. 15 of the literature, the titanium alloy is poor in terms of the ductility, and exhibits such a low tensile strength as less than 1,000 MPa.

It is pointed out herein that none of the literatures set forth actively and positively on the Young's modulus of titanium alloys.

SUMMARY OF THE INVENTION

The present invention has been developed based on concepts which are totally different from the conventional titanium alloys disclosed in the above-described publications. It is an object of the present invention to provide a β titanium alloy which is good in terms of the processability and mechanical characteristics. Moreover, it is another object of the present invention to simultaneously provide a process adapted for producing such a β titanium alloy.

The inventors of the present invention have studied wholeheartedly on low-Young's modulus titanium alloys, and have repeated trials and errors. As a result, they have discovered a novel fact. Namely, even when titanium alloys have a composition exhibiting a relatively low "$Mo_{eq}$" which have been regarded as the unstable regions of β phase, it is possible to produce β single phase titanium alloys which are stable even at room temperature by including oxygen in a large content. Based on the discovery, they have completed the present invention.

Titanium Alloy

A titanium alloy according to the present invention comprises:

when the entirety is taken as 100% by mass, at least one alloying element selected from the group consisting of molybdenum (Mo), vanadium (V), tungsten (W), niobium (Nb), tantalum (Ta), iron (Fe), chromium (Cr), nickel (Ni), cobalt (Co), copper (Cu) and aluminum (Al) in amolybdenum equivalent "$Mo_{eq}$" of from 3 to 11% by mass, the molybdenum equivalent determined by the following equation, $$Mo_{eq}=Mo_{mass}+0.67V_{mass}+0.44W_{mass}+0.28Nb_{mass}+0.22Ta_{mass}+2.9Fe_{mass}+1.6Cr_{mass}+1.1Ni_{mass}+1.4Co_{mass}+0.77Cu_{mass}-Al_{mass},$$ wherein $Mo_{mass}$, $V_{mass}$, $W_{mass}$, $Nb_{mass}$, $Ta_{mass}$, $Fe_{mass}$, $Cr_{mass}$, $Ni_{mass}$, $Co_{mass}$, $Cu_{mass}$ and $Al_{mass}$ are expressed in percentages by mass;

at least one interstitial solution element selected from the group consisting of oxygen (O), nitrogen (N) and carbon (C) in an amount of from 0.3 to 3% by mass; and the balance of titanium (Ti);

the content of Al being controlled to 1.8% by mass or less; and being β single phase substantially at room temperature (e.g., from 273 to 313 K, being the same hereinafter) at least.

Titanium alloys exhibit enhanced strength when hexagonal crystalline α phase exists therein. However, titanium alloys are poor accordingly in terms of the processability. In view of expanding the application of titanium alloys, β titanium alloys comprising cubic crystals have been longed for, because β titanium alloys are good in terms of the processability and mechanical characteristics.

As described above, the conventional titanium alloys have a composition whose "$Mo_{eq}$" is great thoroughly, "$Mo_{eq}$"≧13% by mass, for instance. However, the greater the "$Mo_{eq}$" is, the larger the content of alloying elements increases accordingly. Therefore, the enlargement of the "$Mo_{eq}$" results inevitably in raising the cost, increasing the density, and lowering the specific strength.

In accordance with the present invention, it is possible to produce stable β single phase titanium alloys not only by diminishing the "$Mo_{eq}$" to relatively lesser values but also by including interstitial solution elements such as O in a relatively large content. Accordingly, not only the present titanium alloy little causes the considerable cost increment and density enlargement, but also it is good in terms of the processability and mechanical characteristics.

Note that the "β single phase" set forth in the present specification shall designate that it can be satisfactory that the structure of titanium alloys comprises β phase alone substantially within recognizable ranges when samples are observed by X-ray diffraction analysis. Therefore, the "β single phase" includes structures in which α phase and the like are present in such a trace amount that cannot be detected even by X-ray diffraction analysis.

The detailed mechanism how such titanium alloys are produced has not necessarily been cleared out yet. However, it is believed as hereinafter described.

Firstly, when titanium alloys whose content of interstitial solution elements such as O is controlled less than 0.3% by mass while the "$Mo_{eq}$" falls in a range of from 3 to 11% by mass are produced by an ordinary melting method, the resulting titanium alloys are two phase alloys in which α phase and β phase exist at room temperature. When such titanium alloys are subjected to a solution treatment in which workpieces are quenched from sufficiently high temperatures, the quasi-stable phase like α' phase or α" phase can appear instead of α phase. Since the interstitial solution elements such as O are the α phase-stabilizing element, it has been said as follows: the more the content of the interstitial solution elements is enlarged, the more α phase and the quasi-stable phase like α' phase or α" phase are likely to generate. However, nobody has ever shown how the interstitial solution elements affect the generation behavior of such phases.

Contrary to such general recognition, the present inventors have found out first that the generation of the quasi-stable phase like α' phase or α" phase is suppressed after solution treatments even when titanium alloys whose "$Mo_{eq}$" falls in a range of from 3 to 11% by mass include the interstitial solution elements such as O in a greater content. The present inventors believe the reason as follows.

In order to generate α' phase or α" phase out of β phase which is stable at elevated temperatures when titanium alloys are quenched from high-temperature regions to room-temperature regions, it is necessary for the crystalline lattice to undergo shearing or shuffling. However, when the interstitial solution elements such as O exist, such a process is less likely to occur. Accordingly, it is less likely to generate α' phase or α" phase. Consequently, it is believed possible to produce β single phase titanium alloys which were stable even at room temperature.

To be more specific, the generation of α' phase or α" phase requires shape distortion which occurs in octahedral voids in which the interstitial solution elements exist by shearing or shuffling accompanied by quenching. However, the shape distortion changes the stress field around the interstitial solution elements to make the structure around the interstitial solution elements unstable energetically. As a result, it is believed that the more the content of the interstitial solution element increases, the more such distortion is controlled to inhibit α' phase or α" phase from generating.

Note that α phase or α' phase set forth herein is hexagonal crystals and degrades the processability of titanium alloys. Although α" phase is orthorhombic crystals and does not degrade the processability of titanium alloys, it causes the stress induced transformation of from β phase to α" phase at relatively low stress levels when it is distorted. Accordingly, α" phase might possibly result in causing to lower or degrade the proportional limit, elastic strength and fatigue resistance of titanium alloys.

Production Process of Titanium Alloy

The production process of the present titanium alloy is not limited at all. However, it is possible to efficiently produce the present titanium alloy by a production process according to the present invention, for example.

The present production process comprises:

subjecting a raw titanium-alloy material to a solution treatment, the raw titanium-alloy material comprising:

when the entirety is taken as 100% by mass, at least one alloying element selected from the group consisting of Mo, V, W, Nb, Ta, Fe, Cr, Ni, Co, Cu and Al in a molybdenum equivalent "$Mo_{eq}$" of from 3 to 11% by mass, the molybdenum equivalent determined by the following equation, $Mo_{eq}=Mo_{mass}+0.67V_{mass}+0.44W_{mass}+0.28Nb_{mass}+0.22Ta_{mass}+2.9Fe_{mass}+1.6Cr_{mass}+1.1Ni_{mass}+1.4Co_{mass}+0.77Cu_{mass}-Al_{mass}$, wherein $Mo_{mass}$, $V_{mass}$, $W_{mass}$, $Nb_{mass}$, $Ta_{mass}$, $Fe_{mass}$, $Cr_{mass}$, $Ni_{mass}$, $Co_{mass}$, $Cu_{mass}$, and $Al_{mass}$ are expressed in percentages by mass;

at least one interstitial solution element selected from the group consisting of O, N and C; and the balance of Ti;

the content of Al being controlled to 1.8% by mass or less;

the solution treatment comprising the steps of:

heating the raw titanium-alloy material to form β single phase therein; and quenching the heated raw titanium-alloy material, whereby producing a titanium alloy being β single phase substantially at room temperature at least.

In the present production process, a raw titanium-alloy material is prepared which comprises an interstitial solution element such as O in a relatively large content while the "$Mo_{eq}$" is controlled in a range of from 3 to 11% by mass, and is first heated to sufficiently high temperature regions in order to form β single phase. Thereafter, the raw titanium-alloy material is quenched so that the interstitial solution element such as O suppresses the generation of the quasi-stable phase like α' phase or a" phase as described above. As a result, it is believed possible to produce β single phase titanium alloys which are stable even at room temperature. The detailed mechanism has not necessarily been apparent at present as set forth above.

Note that it is important to turn the raw titanium-alloy material into β single phase as a whole in the heating step of the solution treatment according to the present production process. Accordingly, it is preferable to control the lower limit temperature to an α+β/β transformation temperature or more in the heating step. When α phase-stabilizing elements such as O are present, an α+β/β transformation temperature rises. In particular, the content of α phase-stabilizing elements is large in the present production process, and thereby the increment degree of the α+β/β transformation temperature enlarges accordingly. However, when the raw titanium-alloy material is heated to the α+β/β transformation temperature or more to make it into β single phase as a whole, it is possible to stably produce titanium alloys which comprise β single phase as a whole though the raw titanium-alloy material comprises an interstitial solution elements such as O in a large amount. Note that it is impossible to specify the α+β/β transformation temperature explicitly, because it depends on the composition of titanium alloys.

Thus, in accordance with the present production process, it is possible to produce β single phase titanium alloys over a comparatively wide compositional range. The resulting titanium alloys are good in terms of the processability as well as at least one of the following mechanical characteristics: the strength, the flexibility (e.g., Young's modulus), and the ductility.

In the present titanium alloy, an important factor is the composition. For example, the composition can be satisfactory as far as it produces β single phase by solution treatments. In other words, the alloy structure of the present titanium alloy can be transformed from β single phase when the present titanium alloy is further subjected to heat treatments such as an aging treatment, for instance, or when it is exposed to service environment variations such as from services at room temperature to services in high-temperature regions, for example.

In the present invention, the "$Mo_{eq}$" is controlled in a range of from 3 to 11% by mass because of the following reasons. When the "$Mo_{eq}$" is less than 3% by mass, the stability of β phase lowers so that it is difficult to produce β single phases. When the "$Mo_{eq}$" exceeds 11% by mass, it results in raising the cost and enlarging the density as described above, though it is likely to produce β phase.

From such a perspective, the lower limit of the "$Mo_{eq}$" can further preferably be 3.5% by mass, 4% by mass and 5% by mass in the ascending order. Moreover, the upper limit of the "$Mo_{eq}$" can further preferably be 10.5% by mass, 10% by mass and 9% by mass in the descending order.

In the present invention, the content of interstitial solution elements such as O is controlled in a range of from 0.3 to 3% by mass because of the following reasons. When the content of interstitial solution elements is less than 0.3% by mass, it is difficult to fully inhibit the generation of the quasi-stable phase like α' phase or α" phase. When the content of interstitial solution elements exceeds 3% by mass, the stability of α' phase is enhanced so that it is difficult to form β single phase even at elevated temperatures.

From such a perspective, the lower limit of the content of interstitial solution elements can further preferably be 0.35% by mass, 0.4% by mass, 0.5% by mass, 0.6% by mass and 0.7% by mass in the ascending order. Moreover, the upper limit of the content of interstitial solution elements can further preferably be 2.9% by mass and 2.8% by mass in the descending order.

Note that it is possible to couple the respective lower limits and upper limits appropriately. Moreover, in the present specification, when the composition range of the respective elements is specified in a form of "from x to y % by mass," it means to include the lower limit "x" and the upper limit "y" unless otherwise specified.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
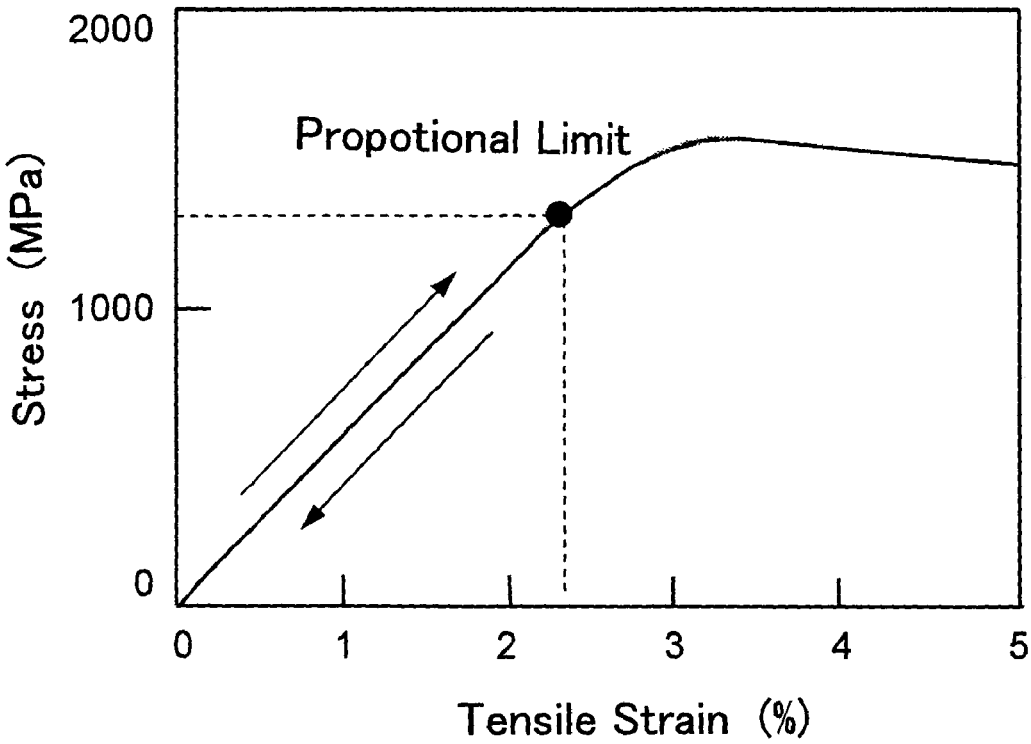
FIG. 1 is a stress-strain diagram exhibited by Test Piece No. 4 according to an example of the present invention.

Having generally described the present invention, a further understanding can be obtained by reference to the specific preferred embodiments which are provided herein for the purpose of illustration only and not intended to limit the scope of the appended claims.

Hereinafter, the present invention will be described in more detail while giving specific examples. Note that the following descriptions are appropriately applicable not only to the present titanium alloy but also to the present process for producing the same.

(1) Alloying Element

The major alloying elements to be included in the present titanium alloy as well as the raw titanium-alloy material, and the contents are determined so that the "$Mo_{eq}$" falls in a range of from 3 to 11% by mass. Depending on which alloying elements are selected and combined to make the present titanium alloy, the upper limit and lower limit of the respective alloying elements vary in accordance with the "$Mo_{eq}$" conversion equation. However, it is preferable to appropriately determine the type and content of the alloying elements while taking the following viewpoints into consideration.

Note that present invention relates to titanium alloys whose major component is Ti. Ti makes the balance of the present titanium alloy excepting the other alloying elements, and accordingly the content of Ti is not limited in particular. For example, when the composition of the present titanium alloy is observed by atomic percentage, it is satisfactory that Ti can be the most abundant element among the constituent elements. In particular, when the Ti content is 50 atomic % or more with respect to the entire present titanium alloy taken as 100 atomic %, it is preferable in view of lowering the density and enhancing the specific strength. Moreover, the inevitable impurities can exist in the present titanium alloy naturally.

Molybdenum (Mo), chromium (Cr) and tungsten (W) set forth in the "$Mo_{eq}$" conversion equation are elements which upgrade the strength and hot workability of titanium alloys. The present titanium alloy can preferably comprise at least one element selected from the group consisting of Mo, Cr and W in an amount of 20% by mass or less. When the content of Mo, Cr or W exceeds 20% by mass, the segregation of materials is likely to occur so that it is difficult to produce homogenous materials. The content of the Mo, Cr or W can preferably be 1% by mass or more, and can desirably fall in a range of from 3 to 15% by mass.

Similarly to Mo, Cr and W, iron (Fe), nickel (Ni) and cobalt (Co) are elements which upgrade the strength and hot workability of titanium alloys. The present titanium alloy can preferably comprise at least one element selected from group consisting of Fe, Ni and Co in an amount of 10% by mass or less. The present titanium alloy can comprise Fe, Ni or Co instead of Mo, Cr or W, or together therewith. When the content of Fe, Ni or Co exceeds 10% by mass, intermetallic compounds occur between Ti and Fe, Ni and Co so that resulting titanium alloys exhibit lowered ductility. The content of the Fe, Ni or Co can preferably be 1% by mass or more, and can desirably fall in a range of from 2 to 7% by mass.

The Va group elements such as vanadium (V), niobium (Nb) and tantalum (Ta) are elements which not only stabilize β phase but also lower the Young's modulus of titanium alloys. The present titanium alloy can preferably comprise at least one element selected from group consisting of the Va group elements in an amount of from 3 to 40% by mass. When the content of the Va group elements is less than 3% by mass, the advantages of the addition are effected less. When the content of the Va group element exceeds 40% by mass, the segregation of materials impairs the homogeneity of resulting materials, and accordingly it is likely to cause not only the lowering of the strength of resulting titanium alloys but also the degradation of the toughness and ductility. It is desired that the content of the Va group elements can fall in a range of from 25 to 40% by mass, further from 30 to 38% by mass, furthermore from 32 to 38% by mass.

Aluminum (Al) is an element which enhances the strength of titanium alloys. However, when the content of the interstitial solution elements is large, and in particular if the content of Al is increased too much, the ductility of resulting titanium alloys lowers. Moreover, the "$Mo_{eq}$" is thereby decreased accordingly. Therefore, in the present invention, the upper limit of the Al content is controlled to 1.8% by mass. The upper limit of the Al content can preferably be 1.7% by mass, 1.6% bypass or 1.5% by mass. In the present titanium alloy, Al is not a requisite element. Hence, it is not necessary to specify the lower limit of the Al content. Indeed, it can be said daringly that the lower limit of the Al content is 0% by mass. However, when the strength of titanium alloys is upgraded by adding Al, it is preferred that the lower limit of the Al content can be 0.3% by mass, further 0.4% by mass, furthermore 0.5% by mass. For reference, the lowering of the ductility might eventually cause to degrade the elastic deformability, because breakage might possibly occur before the plastic deformation starts.

The major alloying elements appearing in the "$Mo_{eq}$" conversion equation have been described so far. However, in addition to the major alloying elements, the present titanium alloy as well as the raw titanium-alloy material can further comprise at least one additional alloying element selected from the group consisting of the following various alloying elements, for instance: copper (Cu), zirconium (Zr), hafnium (Hf), scandium (Sc), manganese (Mn), tin (Sn) and boron (B). It is desired that the content of the additional alloying elements can fall in a range of from 0.1 to 10% by mass.

(2) Interstitial Solution Element

The interstitial solution element comprises at least one element selected from the group consisting of O, N and C as described earlier. The present titanium alloy can comprise one or more of the interstitial solution elements in a summed amount of from 0.3 to 3% by mass. Naturally, the present titanium alloy can be free from N and C, and can comprise only O in an amount of from 0.3 to 3% by mass. Moreover, the present titanium alloy can further preferably comprise O in an amount of from 0.5 to 1.5% by mass.

The interstitial solution elements are α phase-stabilizing elements as described above. However, in the present invention, the interstitial solution elements show the effect of suppressing the generation of α' phase and α" phase. In addition, the interstitial solution elements are effective as well in upgrading the strength of titanium alloys.

(3) Solution Treatment

As described above, the solution treatment of the present production process comprises the steps of: heating the raw titanium-alloy material to form β single phase therein; and quenching the heated raw titanium-alloy material.

The heating step is important in order to fully diffuse the respective alloying elements and the interstitial solution element in β phase. The heating step can preferably be carried out so that the raw titanium-alloy material is held to a β transformation temperature or more at which the raw titanium-alloy material is turned into β single phase for from 1 to 60 minutes. Note that the heating step cannot necessarily be a step adapted exclusively for solution treatments. For example, the heating step can be coupled with hot working.

In accordance with the quenching step, the heated raw titanium-alloy material is usually cooled rapidly from the high-temperature region associated with the heating step to room-temperature region. In this instance, it is satisfactory that the cooling rate can be controlled so as to produce β single phase at room temperature. For example, when the cooling rate is from 0.5 to 500 K/sec., it is preferable because stable β single phase can be produced.

In the present invention, the production process of the raw titanium-alloy material does not matter at all. For example, the raw titanium-alloy material can be ingot materials, and sintered materials. However, when a sintering method is used instead of melting methods, it is possible to efficiently produce stable-quality titanium alloys without suffering from macro segregation even if the raw titanium-alloy material includes the alloying elements and interstitial solution elements in large contents. Namely, when a sintering method is employed, it is possible to reduce a great deal of man-hour requirements and costs required for melting the raw titanium-alloy material, and to avoid using special facilities. The raw material powder to be used in a sintering method is not limited in particular. However, note that the mixing composition of the raw material powder cannot necessarily coincide with the composition of resulting titanium alloys. This is because the content of O, for instance, depends on atmospheres in which sintering is carried out.

The raw titanium-alloy material can take a variety of forms. For example, the raw titanium-alloy material can be workpieces such as ingots, slabs, billets, sintered bodies, rolled products, forged products, wires, plates and rods. Moreover, the raw titanium-alloy material can be members which are made by subjecting the workpieces to certain working.

(4) Characteristics of Titanium Alloy

The present titanium alloy is naturally good not only in terms of the corrosion resistance and specific strength but also in terms of the processability, because it comprises β single phase substantially. The processing set forth herein can be hot working, cold working and machining, and the types of processing do not matter at all.

Moreover, the present titanium alloy has many good mechanical characteristics additionally, which are distinct from those of α type titanium alloys, because it comprises β single phase. For example, the present titanium alloys exhibits a remarkably lower Young's modulus than that of α type titanium alloys, and exhibits considerably high strength such as a tensile strength, an elastic limit strength and a fatigue strength. Moreover, the present titanium alloy exhibits large ductility or elongation. In addition, the present titanium alloy exhibits a great elastic deformability, because it exhibits a low Young's modulus but a high elastic limit strength. Note that the elastic deformability herein means an elongation within a tensile elastic limit strength.

Note that the goodness of the respective characteristics cannot be specified explicitly because it depends not only on the composition of the present titanium alloy but also treatments, to which the present titanium alloy is subjected, or processes for producing the present titanium alloy. However, the present titanium alloy possesses the following characteristics, for instance: it can be of such flexibility to exhibit a Young's modulus of 70 GPa or less; it can be of such high strength to exhibit a tensile strength of 1,000 MPa or more, or a tensile elastic limit strength of 800 MPa or more; it can be of such high elasticity to exhibit an elastic deformability of 1.6% or more.

(5) Application of Titanium Alloy

Based on the above-described characteristics, it is possible to use the present titanium alloy widely in a variety of products. Moreover, it is possible to improve the productivity and reduce the costs involved with ease, because the present titanium alloy exhibits a good cold workability as well. For example, it is possible to apply the present titanium alloy to industrial machines, automobiles, motorbikes, bicycles, precision appliances, household electric appliances, aero and space apparatuses, ships, accessories, sports and leisure articles, products relating to living bodies, medical equipment parts, and toys.

When the present titanium alloy is applied to automotive coiled springs, it is possible to reduce the number of turns compared with those made of conventional spring steels, because it exhibits a low Young's modulus as well as a large elastic deformability. Moreover, it is possible to achieve sharply reducing the weight of automotive coiled springs, because it is much more lightweight than conventional spring steels.

When the present titanium alloy is applied to frames of eyeglasses, one of accessories, or especially to the temples, the portions around the temples are likely to bend so that they fit well with faces, because the present titanium alloy exhibits a low Young's modulus. Moreover, such frames are good in terms of the impact absorbing property and configurational recovering property. In addition, it is easy as well to form frames of eyeglasses from fine line materials and to improve the material yield, because the present titanium alloy is not only of high strength and but also good in terms of the cold workability.

When the present titanium alloy is applied to golf clubs, one of sports and leisure articles, or especially to shafts of golf clubs, such shafts are likely to flex. Accordingly, an elastic energy to be transmitted to golf balls increases so that it is possible to improve the driving distance of golf balls. Moreover, when heads of golf clubs, especially, the face parts comprise the present titanium alloy, the intrinsic frequency of heads can be reduced remarkably compared with that of conventional titanium alloys because of the low Young's modulus and the thinning resulting from the high strength. Consequently, it is possible to greatly extend the driving distance of golf balls by playing with golf clubs provided with such heads. In addition, it is possible as well to upgrade the hitting feeling of golf clubs by the present titanium alloy because of the good characteristics. Thus, it is possible to sharply expand the degree of freedom in designing golf clubs.

In the field of medical treatments, it is possible to use the present titanium alloy in artificial bones, artificial joints, artificial transplantation tissues and fasteners for bones, which are disposed in living bodes, as well as in functional members of medical instruments, such as catheters, forcepses and valves. For example, when artificial bones comprise the present titanium alloy, such artificial bones are good in terms of the living body compatibility, and simultaneously exhibit sufficiently high strength as bones, because they exhibit a low Young's modulus, which is close to that of human bones and keep up the balance between them and human bones.

The present titanium alloy is suitable for dampers as well. This is because it is possible to reduce the acoustic velocity, which is transmitted in the materials of dampers by decreasing the Young's modulus, as can be seen from the relational equation, $E=\rho V2$, wherein E is a Young's modulus, ρ is a material density and V is an acoustic velocity transmitted in the material.

Moreover, the present titanium alloy can be used in the following various products for the following versatile fields, for example: raw materials, such as wires, rods, square bars, plates, foils, fibers and fabrics; portable articles, such as clocks (e.g., wrist watches), barrettes (e.g., hair accessories), necklaces, bracelets, earrings, pierces, rings, tiepins, brooches, cuff links, belts with buckles, lighters, nibs of fountain pens, clips for fountain pens, key rings, keys, ballpoint pens and mechanical pencils; portable information terminals, such as cellular phones, portable recorders and cases of mobile personal computers; springs for engine valves; suspension springs; bumpers; gaskets; diaphragms; bellows; hoses; hose bands; tweezers; fishing rods; fishhooks; sewing needles; needles for sewing machines; syringe needles; spikes; metallic brushes; chairs; sofas; beds; clutches; bats; various wires; various binders; clips for papers; cushioning materials; various metallic seals; expanders; trampolines; various physical fitness exercise apparatuses; wheelchairs; nursing apparatuses; rehabilitation apparatuses; brassieres; corsets; camera bodies; shutter component parts; blackout curtains; curtains; blinds; balloons; airships; tents; various membranes; helmets; fishing nets; tea strainers; umbrellas; firemen's garments; bullet-proof vests; various containers, such as fuel tanks; inner linings of tires; reinforcements of tires; chassis of bicycles; bolts; rulers; various torsion bars; spiral springs; and power transmission belts, such as CVT (i.e., continuously variable transmission) hoops.

Note that the present titanium alloy and products comprising the same can be produced by a variety of production processes, such as casting, forging, super plastic forming, hot working, cold working and sintering.

EXAMPLES

The present invention will be hereinafter described more specifically with reference to specific examples.

Production of Samples

As samples, Test Piece Nos. 1 through 4 and Comparative Test Piece Nos. C1 through C3 were produced in the following manner.

(1) Test Piece Nos. 1 through 4

The following raw material powders were prepared, for instance: a Ti powder, a V powder, an Fe powder, an Al powder, an Mo powder, an Nb powder, a Ta powder, a Zr powder, and an Sn powder. Note that the prepared raw material powders had an average particle diameter of 45 μm or less. The raw material powders were weighed, and were compounded so as to make the alloying compositions set forth in Table 1 below. The resulting mixtures were further mixed with a ball mill for 2 hours, thereby making mixture powders (i.e., a mixing step).

The resulting mixture powders were subjected to CIP (i.e., cold isostatic pressing) under a static pressure of 400 MPa (i.e., 4 ton/cm$^2$), thereby producing ϕ 40×80 mm cylinder-shaped powder compacts (i.e., a forming step).

The resulting cylinder-shaped powder compacts were sintered in a vacuum of $1\times10^{-5}$ torr (i.e., $1.3\times10^{-5}$ Pa) at 1,300° C. for 16 hours, thereby making sintered bodies (i.e., a sintering step). Moreover, the sintered bodies were hot forged in air at 1,050° C. (i.e., a hot working step), thereby elongating them to ϕ 18 mm round bars (i.e., raw titanium-alloy materials).

The resulting round bars were heated to an α+β/β transformation temperature or more in an Ar gas atmosphere, and were held at the temperature for a predetermined period of time, respectively (i.e., a heating step). Thereafter, the round bars were cooled with water (i.e., a quenching step), thereby carrying out a solution treatment. Note that, in the solution treatment, the round bars were heated at a temperature of from 900 to 1,050° C. for 30 minutes before they were quenched.

The resulting round bars (or solution-treated alloys) were cut out to predetermined pieces. A part of the cut-out pieces were reduced diametrically to ϕ 8.5mm by subjecting them to cold swaging (i.e., a cold swaging step). The cold-swaged pieces were further subjected to machining, thereby producing ϕ 8×30 mm Test Piece Nos. 1 through 4. Note that the cold working ratio was about 78% in the cold swaging.

(2) Comparative Test Piece Nos. C1 through C3

Comparative Test Piece Nos. C1 though C3 were produced by varying the "$Mo_{eq}$," the O content or the Al content from those of Test Piece Nos. 1 through 4. Table 1 sets forth the compositions of Comparative Test Piece Nos. C1 through C3 altogether as well. Note that Comparative Test Piece Nos. C1 through C3 were produced in the same manner as Test Piece Nos. 1 through 4.

Measurements on Test Pieces

The mechanical characteristics of the respective test pieces were determined by the following methods.

(1) Young's Modulus, Tensile Strength, Tensile Elastic Limit Strength and Elastic Deformability The test pieces were subjected to a tensile test with an Instron testing machine(e.g., a universal tensile testing machine produced by Instron Co., Ltd.), respectively. The loads and elongations were measured to prepare a stress-strain diagram. Note that the elongations were calculated from the outputs from a strain gage which was bonded on the peripheral surface of the test pieces.

The characteristics of the respective test pieces were determined from the stress-strain diagram. Table 1 sets forth the results altogether. Note that the elastic deformability is a strain within a tensile elastic limit strength. The tensile elastic limit strength was determined as a stress which could cause a 0.2% permanent strain in a tensile test in which a predetermined load was loaded to and unloaded from a test piece repeatedly. As an example of the stress-strain diagram, FIG. 1 illustrates a stress-strain diagram which Test Piece No. 4 exhibited.

(2) Structure after Solution Treatment

The test pieces were examined by an X-ray diffraction analysis for the structure after the solution treatment, respectively. Table 1 sets forth the results of the examination altogether.

(3) Occurrence of Stress Induced Transformation

The test pieces were examined whether a stress induced transformation occurred or not, respectively. The examination was carried out by an X-ray diffraction analysis while a predetermined tensile stress was applied to the respective test pieces. Table 1 sets forth the results of the examination altogether.

TABLE 1

| Test Piece No. | Composition (% by mass) Alloying Element | Oxygen | "$Mo_{eq}$" | Mechanical Characteristic Young's Modulus (GPa) | Tensile Strength (MPa) | Tensile Elastic Limit Strength (MPa) | Elastic Deformability (%) | Structure after Solution Treatment | Occurrence of Stress Induced Transformation |
|---|---|---|---|---|---|---|---|---|---|
| 1 | Ti-8% V-1% Fe | 0.6 | 8.26 | 60 | 1392 | 1203 | 2.0 | β Single Phase | None |
| 2 | Ti-10% Mo-6% Zr-4.5% Sn | 0.6 | 10.00 | 63 | 1315 | 998 | 1.9 | β Single Phase | None |
| 3 | Ti-25% Nb-2% Ta | 1.5 | 7.44 | 65 | 1820 | 1569 | 2.2 | β Single Phase | None |
| 4 | Ti-32% Nb-2% Ta-3% Zr | 0.8 | 9.40 | 50 | 1593 | 1324 | 2.8 | β Single Phase | None |
| C1 | Ti-40% Nb-10% Ta-5% Zr | 0.3 | 13.40 | 80 | 981 | 789 | 1.0 | β Single Phase | None |
| C2 | Ti-4% Mo-3% Al | 0.6 | 2.00 | 100 | 1410 | 1121 | 1.1 | α Phase + β Phase | None |
| C3 | Ti-32% Nb-2% Ta | 0.2 | 9.40 | 50 | 904 | 487 | 1.0 | α" Phase + β Phase | Occurred |

Assessment

As can be seen from Table 1, the structure of all of Test Piece Nos. 1 through 4 (i.e., the titanium alloys whose "$Mo_{eq}$" fell in a range of from 3 to 11% by mass and the content of the interstitial solution element, the content of O, fell in a range of from 0.3 to 3% by mass) was turned into β single phase after the solution treatment. In addition, it is appreciated that no stress induced transformation occurred in the titanium alloys according to Test Piece Nos. 1 through 4, and that their β single phase was stabilized.

Further, the titanium alloys according to Test Piece Nos. 1 through 4 exhibited such a low Young's modulus as 70 GPa or less. Furthermore, they were of such remarkably high strength as well to exhibit a tensile strength of 1,000 MPa or more. Moreover, they exhibited such high elasticity that the elastic deformability was 1.6% or more. In particular, as can be seen from FIG. 1, the titanium alloy according to Test Piece No. 4 exhibited such a high proportional limit as 1,300 MPa so that the elastic deformability reached as high as 2.8%.

Having now fully described the present invention, it will be apparent to one of ordinary skill in the art that many changes and modifications can be made thereto without departing from the spirit or scope of the present invention as set forth herein including the appended claims.

What is claimed is:

1. A titanium alloy that is β single phase at room temperature consisting of:

when the entirety is taken as 100% by mass, at least one alloying element selected from the group consisting of molybdenum (Mo), vanadium (V), tungsten (W), niobium (Nb), tantalum (Ta), iron (Fe), chromium (Cr), and copper (Cu) in a molybdenum equivalent "$Mo_{eq}$" of from 3 to 11% by mass, the molybdenum equivalent determined by the following equation, $$Mo_{eq}=Mo_{mass}+0.67V_{mass}+0.44W_{mass}+0.28Nb_{mass}+0.22Ta_{mass}+2.9Fe_{mass}+1.6Cr_{mass}+0.77Cu_{mass},$$

wherein $Mo_{mass}$, $V_{mass}$, $W_{mass}$, $Nb_{mass}$, $Ta_{mass}$, $Fe_{mass}$, $Cr_{mass}$, and $Cu_{mass}$ are expressed in percentages by mass;

an interstitial solution element that is oxygen (O) in an amount of from 0.6 to 3% by mass; and the balance of titanium (Ti);

wherein said titanium alloy is produced by a solution treatment comprising:

heating a raw titanium alloy material to form a β single phase at a temperature above the α+β/β transformation temperature of the raw titanium alloy material; and quenching the heated raw titanium alloy material to form a titanium alloy that is a β single phase at room temperature;

wherein said titanium alloy has a flexibility characterized by a Young's modulus of 70 GPa or less, exhibits a tensile strength of 1,000 MPa or more, and exhibits an elastic deformability of 1.6% or more.

2. The titanium alloy set forth in claim 1, wherein the $Mo_{eq}$ of said at least one alloying element is of from 3.5 to 10.5% by mass.

3. The titanium alloy set forth in claim 1, wherein the interstitial element oxygen is in an amount of from 0.7 to 3% by mass.

4. The titanium alloy of claim 1, which is produced by a process involving solution treatment comprising:

heating the raw titanium-alloy material for a time sufficient to form β single phase therein; and quenching the heated raw titanium-alloy material;

thereby producing a titanium alloy characterized as a β single phase at 273-313 K.

5. The titanium alloy of claim 1, wherein the interstitial solution element that is oxygen (O) is present in an amount of from 1.5 to 3% by mass.

6. A titanium alloy consisting of:

when the entirety is taken as 100% by mass, at least one alloying element selected from the group consisting of molybdenum (Mo), vanadium (V), tungsten (W), niobium (Nb), tantalum (Ta), iron (Fe), chromium (Cr), and copper (Cu) in a molybdenum equivalent "$Mo_{eq}$" of from 3 to 11% by mass, the molybdenum equivalent determined by the following equation, $$Mo_{eq}=Mo_{mass}+0.67V_{mass}+0.44W_{mass}+0.28Nb_{mass}+0.22Ta_{mass}+2.9Fe_{mass}+1.6Cr_{mass}+0.77Cu_{mass},$$

wherein $Mo_{mass}$, $V_{mass}$, $W_{mass}$, $Nb_{mass}$, $Ta_{mass}$, $Fe_{mass}$, $Cr_{mass}$, and $Cu_{mass}$ are expressed in percentages by mass;

at least one additional alloying element selected from the group consisting of zirconium (Zr), hafnium (Hf), scandium (Sc), manganese (Mn), tin (Sn) and boron (B) in an amount of from 0.1 to 10% by mass;

an interstitial solution element that is oxygen (O) in an amount of from 0.6 to 3% by mass; and the balance of titanium (Ti); and being β single phase at room temperature;

wherein said titanium alloy is produced by a solution treatment comprising:

heating a raw titanium alloy material to form a β single phase at a temperature above the α+β/β transformation temperature of the raw titanium alloy material; and quenching the heated raw titanium alloy material to form a titanium alloy that is a β single phase at room temperature.

7. The titanium alloy set forth in claim 6, wherein the $Mo_{eq}$ of said at least one alloying element is of from 3.5 to 10.5% by mass.

8. The titanium alloy set forth in claim 6, wherein the interstitial element oxygen is in an amount of from 0.7 to 3% by mass.

* * * * *